US007875837B1

(12) United States Patent
Szabo et al.

(10) Patent No.: US 7,875,837 B1
(45) Date of Patent: Jan. 25, 2011

(54) MISSILE TRACKING WITH INTERCEPTOR LAUNCH AND CONTROL

(75) Inventors: Renee Szabo, Arlington, MA (US); Christian E. Pedersen, Moorestown, NJ (US); Wade E. Cooper, Medford, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 426 days.

(21) Appl. No.: 11/971,559

(22) Filed: Jan. 9, 2008

(51) Int. Cl.

| | |
|---|---|
| ***F41G 7/00*** | (2006.01) |
| ***F42B 15/01*** | (2006.01) |
| ***G01S 7/40*** | (2006.01) |
| *F42B 15/00* | (2006.01) |
| *G01S 7/00* | (2006.01) |

(52) U.S. Cl. ..... 244/3.15; 244/3.1; 244/3.16; 244/3.19; 89/1.11; 342/61; 342/62; 342/67; 342/165; 342/173; 342/175; 342/195; 702/127; 702/179; 702/189

(58) Field of Classification Search ..... 244/3.1–3.3; 89/1.11; 342/61–68, 73–81, 89, 90, 118, 342/146–158, 165–175, 195; 702/127, 179–181, 702/189–199

See application file for complete search history.

(56) References Cited

U.S. PATENT DOCUMENTS

| | | | | | |
|---|---|---|---|---|---|
| 3,156,435 | A | * | 11/1964 | Norton et al. | 244/3.14 |
| 3,738,593 | A | * | 6/1973 | Duvall | 244/3.14 |
| 3,883,091 | A | * | 5/1975 | Schaefer | 244/3.13 |
| 3,982,713 | A | * | 9/1976 | Martin | 244/3.1 |
| 3,990,657 | A | * | 11/1976 | Schott | 244/3.15 |
| 4,925,129 | A | * | 5/1990 | Salkeld et al. | 244/3.11 |
| 5,053,622 | A | * | 10/1991 | Kessler | 89/1.11 |
| 5,056,740 | A | * | 10/1991 | Roth et al. | 244/3.15 |
| 5,198,607 | A | * | 3/1993 | Livingston et al. | 89/1.11 |
| 5,340,056 | A | * | 8/1994 | Guelman et al. | 244/3.16 |
| 5,458,041 | A | * | 10/1995 | Sun et al. | 89/1.11 |
| 5,464,174 | A | * | 11/1995 | Laures | 244/3.11 |
| 5,600,434 | A | * | 2/1997 | Warm et al. | 89/1.11 |
| 5,661,254 | A | * | 8/1997 | Steuer et al. | 244/3.28 |
| 5,662,291 | A | * | 9/1997 | Sepp et al. | 244/3.13 |
| 5,710,423 | A | * | 1/1998 | Biven et al. | 244/3.1 |
| 5,862,496 | A | * | 1/1999 | Biven | 244/3.15 |
| 5,866,837 | A | * | 2/1999 | Biven et al. | 89/1.11 |

(Continued)

*Primary Examiner*—Bernarr E Gregory
(74) *Attorney, Agent, or Firm*—Duane Morris LLP

(57) ABSTRACT

A method for engaging a hostile missile with an interceptor missile includes mathematically dividing an estimated target trajectory into portions, the junction of each portion with the next defining a possible intercept point. The engagement for each possible intercept point is modeled, to generate a probability of lethal object discrimination which is processed to generate a probability of intercept for each of the possible intercept points. The intercept point having the largest probability of intercept defines a selected intercept point from which intercept missile launch time is calculated, interceptor missile guidance is initialized, and the interceptor is launched at the calculated launch time and under the control of the interceptor missile guidance. Also, a method for estimating discrimination performance of a system of sensors includes generating sensor data signal-to-noise ratio and an aspect angle between the sensor and a lethal object. A table of probability of lethal object discrimination is generated as a function of the signal-to-noise ratio and aspect angle. The signal-to-noise ratio and the aspect angle are quantized into bins and the table with at least the signal-to-noise ratio and the aspect angle is entered to determine the probability of lethal object discrimination.

3 Claims, 6 Drawing Sheets

U.S. PATENT DOCUMENTS 6,199,471 B1 * 3/2001 Perruzzi et al. ..... 342/62
6,209,820 B1 * 4/2001 Golan et al. ..... 244/3.15
6,527,222 B1 * 3/2003 Redano ..... 244/3.14
6,575,400 B1 * 6/2003 Hopkins et al. ..... 244/3.19
6,666,401 B1 * 12/2003 Mardirossian ..... 244/3.11
6,739,547 B2 * 5/2004 Redano ..... 244/3.14
6,825,792 B1 * 11/2004 Letovsky ..... 342/175
6,845,938 B2 * 1/2005 Muravez ..... 244/3.11
6,877,691 B2 * 4/2005 DeFlumere et al. ..... 244/3.16
6,990,885 B2 * 1/2006 Boyd ..... 89/1.11
7,348,918 B2 * 3/2008 Redano ..... 342/62
7,394,047 B1 * 7/2008 Pedersen ..... 244/3.1
7,473,876 B1 * 1/2009 Pedersen et al. ..... 244/3.1
7,504,982 B2 * 3/2009 Berg et al. ..... 342/62

* cited by examiner

| SNR BIN | ASPECT ANGLE BIN | LAST DEPLOYMENT EVENT | DISCRIMINATION EVENT OBSERVED | PROBABILITY OF DISCRIMINATION |
|---|---|---|---|---|
| 1 | 1 | 1 | 1 | 0.5 |
| 2 | 1 | 1 | 1 | 0.8 |
| 1 | 2 | 1 | 1 | 0.6 |
| 2 | 2 | 1 | 1 | 0.7 |
| 1 | 1 | 2 | 1 | 0.2 |
| 2 | 1 | 2 | 1 | 0.1 |
| 1 | 2 | 2 | 1 | 0.8 |
| 2 | 2 | 2 | 1 | 0.4 |
| 1 | 1 | 1 | 0 | 0.4 |
| 2 | 1 | 1 | 0 | 0.7 |
| 1 | 2 | 1 | 0 | 0.4 |
| 2 | 2 | 1 | 0 | 0.5 |
| 1 | 1 | 2 | 0 | 0.9 |
| 2 | 1 | 2 | 0 | 0.1 |
| 1 | 2 | 2 | 0 | 0.9 |
| 2 | 2 | 2 | 0 | 0.3 |

FIG. 3

MISSILE TRACKING WITH INTERCEPTOR LAUNCH AND CONTROL

FIELD OF THE INVENTION

Background of the Invention

Ballistic and intercontinental missiles have the capability of carrying nuclear, biological or chemical weapons. The severe consequences on an industrialized nation of a missile attack with such weapons makes it imperative that thought be given to possible methods for interception.

A traditional missile is unitary, meaning that each missile carries one non-separating lethal warhead or reentry vehicle. One of the problems with defense against missile attack is that the attacker can deploy a cloud of chaff and/or multiple decoy objects during missile flight to confound identification of the actual lethal warhead within the cloud. In the case of Multiple Independently Targeted Reentry Vehicles, the missile may carry a plurality of lethal objects, and dispense multiple decoy objects.

Identification of a target missile or warhead(s), and guidance of an interceptor missile to the lethal portion(s) of the payload are desired.

SUMMARY OF THE INVENTION

A method according to an aspect of the invention is for engaging a hostile missile with an interceptor missile. The method comprises the steps of sensing a hostile missile to thereby generate sensed target data, and generating from the sensed target data an estimated target trajectory. The estimated target trajectory is mathematically divided into portions. The junction of each portion with the next defines a possible intercept point. The engagement for each of the possible intercept points is modeled, to thereby generate a probability of lethal object discrimination. The probability of lethal object discrimination is processed to generate a probability of intercept for each of the possible intercept points. That one of the possible intercept points having the largest probability of intercept is selected to define a selected intercept point. From the selected intercept point, an intercept missile launch time is calculated. The interceptor missile guidance is initialized with information relating to the selected intercept point. The interceptor missile is launched at the calculated launch time and under the control of the interceptor missile guidance.

A method according to an aspect of the invention is for engaging a hostile missile with an interceptor missile. The method comprises the step of sensing a hostile missile to thereby generate sensed target data. The method also includes the step of generating, from the sensed target data, an estimated target trajectory. The estimated trajectory is divided into portions, with the junction of each portion with the next defines a possible intercept point of the missile. The engagement is modeled for each of the possible intercept points, to thereby generate a probability of lethal object discrimination for each of the possible intercept points. The probability of lethal object discrimination is processed to generate a probability of intercept for each of the possible intercept points. That one of the possible intercept points is selected which has the largest probability of intercept, to define a selected intercept point. An intercept missile launch time is calculated from the selected intercept point. The interceptor missile guidance is initialized with information relating to the selected intercept point, and the interceptor missile is launched at the launch time and under the control of the interceptor missile guidance. In a particularly advantageous mode of this method, the step of modeling the engagement comprises the steps of, prior to the engagement, determining the noise performance of the sensor as a function of at least aspect angle and range to a target missile. Also prior to the engagement, the mode includes generating a table of probability of lethal object discrimination as a function of estimated signal-to-noise ratio and of aspect angle. The estimated signal-to-noise ratio is determined from the noise performance of the sensor and the sensed target data. The table is entered with the aspect angle and estimated signal-to-noise ratio for each of the possible intercept points, to thereby generate the probability of lethal object discrimination for each of the possible intercept points. The signal-to-noise ratio of the sensor data is determined. The aspect angle between the sensor and a lethal object in a given coordinate system is also determined. The signal-to-noise ratio is quantized into a bin, and the aspect angle is also quantized into a bin. The table is entered into with the signal-to-noise ratio and the aspect angle to determine the probability of lethal object discrimination. A method according to another aspect of the invention is for estimating discrimination performance of a system of sensors. The method comprises the steps of determining the noise performance of a sensor, and acquiring real-time data from the sensor relating to a lethal object in an environment. The signal-to-noise ratio of the sensor data is determined. The aspect angle between the sensor and a lethal object is determined in a given coordinate system. A table of probability of lethal object discrimination is generated as a function of signal-to-noise ratio and of aspect angle. The signal-to-noise ratio is quantized into a bin, and the aspect angle is quantized into a bin. The table is entered with the signal-to-noise ratio and the aspect angle to determine the probability of lethal object discrimination.

BRIEF DESCRIPTION OF THE DRAWING

FIG. 3 is a representative table of likelihood of discrimination;

DESCRIPTION OF THE INVENTION

Figure 1:
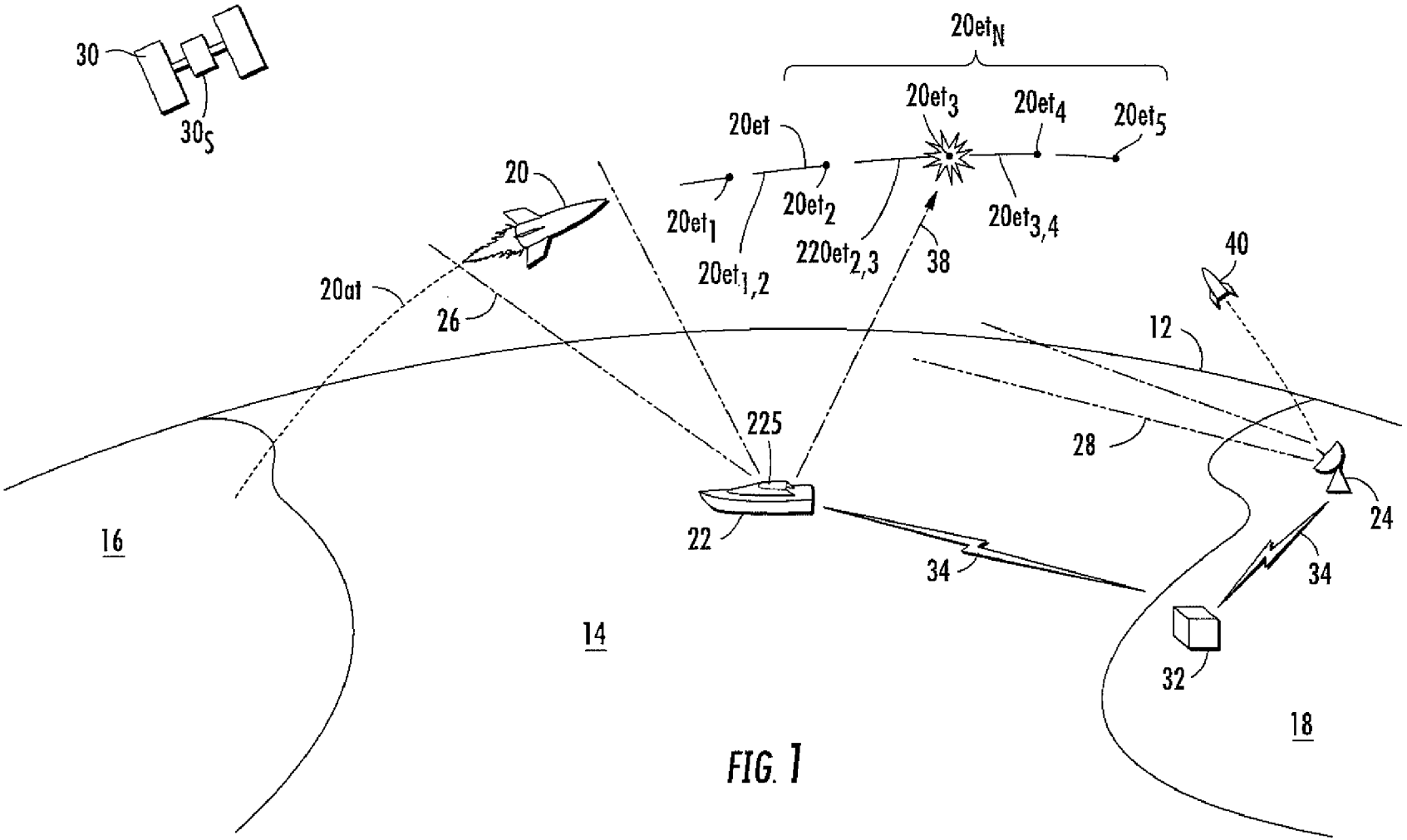
FIG. 1 is a simplified view of a portion of the Earth's surface depicting a scenario in which one or more sensors senses a hostile or target missile in flight, a favorable intercept point is identified, and a friendly asset initializes an interceptor missile with information relating to the favorable intercept point and launches the interceptor missile to intercept the target missile at the favorable intercept point.

FIG. 1 is a simplified view of a portion of the Earth's surface, illustrating a horizon 12, a marine or ocean portion designated generally as 14, a first land mass designated generally as 16, and a second land mass designated generally as 18. In the scenario of FIG. 1, a hostile missile 20 was launched from land mass 16 and followed an actual track illustrated as 20*at*. One or more sensors detect and track the target missile 20. A first sensor illustrated as 22S is mounted on a friendly ship 22, and a second land-based sensor is illustrated as 24. The sensors may be radar sensors, but may also be of other types, such as a satellite-borne Overhead Non-Imaging Infra-Red (ONIR) sensor 30S on a satellite 30. Sensor 22S scans or views over an angle illustrated as 26, which includes the hostile missile 20. Land-based sensor 24 also scans the region (28).

In the scenario of FIG. 1, the various sensors communicate with each other and with a control center, illustrated as a block 32, by communication paths illustrated by "lightning bolt" symbols 34. The sensed signals representing the target missile 20 are processed and evaluated by computerized methods, to estimate the future track or path 20*et* of missile 20. The processing may take place at a single location, such as control center 32 of FIG. 1, or it may be distributed among various locations, such as control center 32, ship 22, and lands site 24. The processing includes, as described below, the estimation of the probability of lethal object discrimination at a set 20*etn* various potential or possible intercept points, such as points 20*et*1, 20*et*2, 20*et*3, 20*et*4, and 20*et*5, along the estimated future path 20*et*. The processing further includes the determination of a probability of intercept based on the probability of lethal object discrimination. That one of the potential intercept points which has the greatest likelihood of intercept is selected as the intercept point. One or more interceptor missiles, such as 38 and 40, are initialized with instructions for intercepting the target missile 20 at the selected intercept point. The selected intercept point is illustrated by the "flash" icon or surround associated with intercept point 20*et*3. The one or more interceptor missiles 38, 40 are launched at times selected to allow the interceptor missile to intercept the target missile at the selected intercept point.

Figure 2:
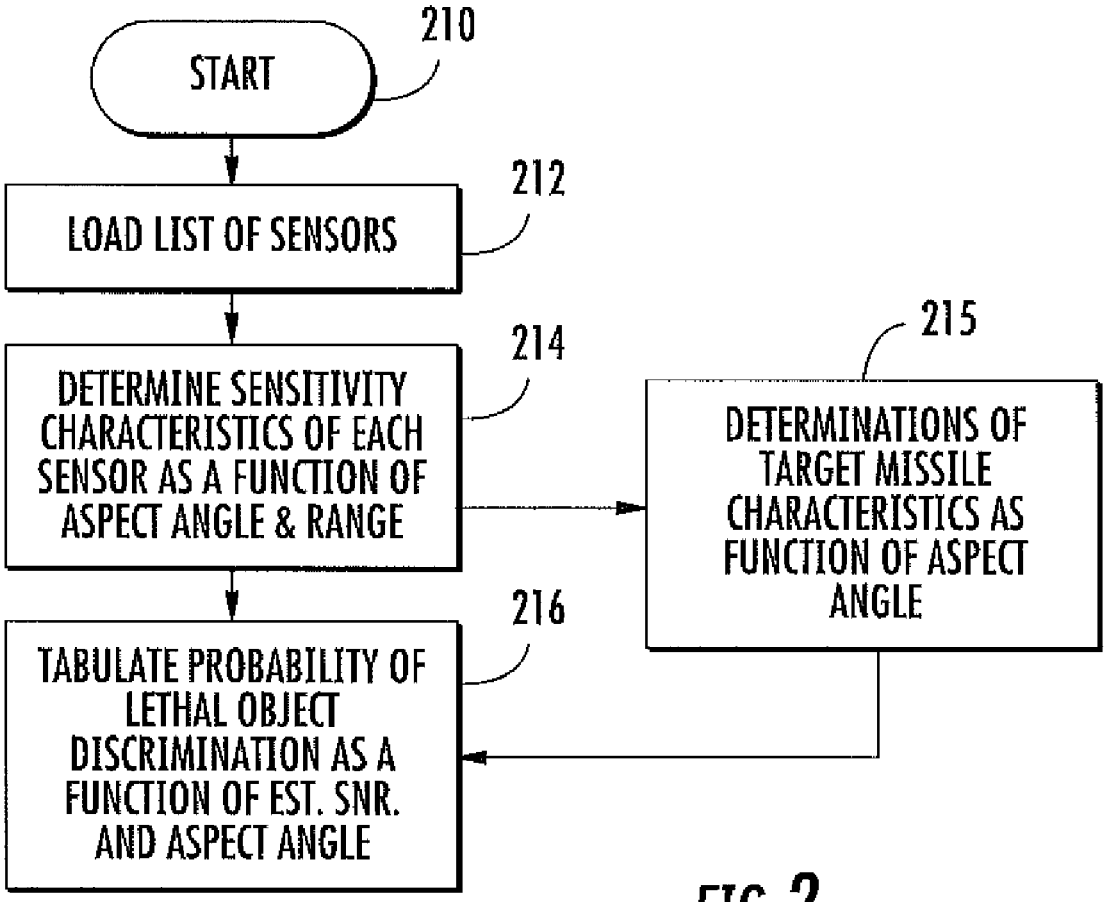
FIG. 2 is a simplified logic flow chart or diagram illustrating preliminary steps according to an aspect of the invention.

FIG. 2 is a simplified logic flow chart or diagram illustrating preliminary steps of the method. Some, many or most of the steps may be performed by processors located at sensor locations of FIG. 1, on vehicles such as ship 22, or at the central location 32, or may be distributed among the locations. In FIG. 2, the logic begins at a START block 210, and flows to a block 212. Block 212 represents the loading of a list of sensors which may be used in the detection and tracking of the target missile, and of the interceptor missile, if desired. From block 212, the preliminary steps of FIG. 2 flow to a block 214. Block 214 represents the determination of the sensitivity characteristics of each of the sensors. From block 214, the logic of FIG. 2 flows to a block 215. Block 215 represents the determination of target missile characteristics, such as the reflective characteristic of radar cross section as a function of the angle between the sensor and the target missile. The determination of target characteristics may also be performed, if desired, by non-radiating means such as observing an infrared image. Block 216 represents the generating of a table of estimated probability of lethal object discrimination as a function of estimated signal-to-noise ratio (SNR) bin, aspect angle bin, the most recent threat missile deployment event, and whether or not that event was observed. A bin refers to the breaking up of the continuum of possible angle and SNR values into discrete bins. As an example, the SNR bins can be from 0 to 50 dB and from 50 dB to 100 dB, and the aspect angle may range from 0° to 180° in 90° increments. However, the bin size is not critical. A threat missile deployment event is defined as any time that more detectable objects are generated by a threat missile. The threat deployment event may be indexed by a number that indicates which deployment event was the last that occurred, (i.e. 1, 2, 3 . . . ) or a physical observable that is related to the deployment event such as time after launch, time after main engine cutoff, or altitude. If a quantity other than an integer event number is used to identify the last deployment event, then this index will be discretized or quantized into bins as for the aspect angle and SNR. Examples of deployment events include the separation of a reentry vehicle from a booster tank or the deployment of countermeasures.

FIG. 3 is a simplified example of a table generated pursuant to block 216 of FIG. 2. Discrimination performance is estimated at one or more times in a ballistic missile's estimated flight and entered into the table. The entries in the lookup table of FIG. 3 are indexed by SNR (Signal-to-Noise Ratio) bin, aspect angle bin, last deployment event, and a flag indicating if the most recent (or last) deployment event was visible to the sensor. The sensor information is used to compute the appropriate SNR and aspect angle bins. The SNR bin is the average SNR that the sensor would see during a window of time before the time at which discrimination performance is to be estimated. Similarly, the aspect angle is the average aspect angle over a window of time before the time at which discrimination performance is to be estimated. The value of the quantity that indexes the last deployment event is based on an approximate knowledge of a threat missile's deployment timeline, where the deployment timeline is the time that the objects are deployed from the threat missile relative to a specific time reference, such as the time of launch. Discrimination performance is obtained from a lookup table. In the lookup table of FIG. 3, the columns are headed "SNR Bin," "Aspect Angle Bin," "Last Deployment Event," "Last Deployment Event Observed" and "Probability of Discrimination". The first column contains SNR bin numbers which can be any integer greater than zero. The second column contains the aspect angle bin numbers. The third column contains the last deployment event number (or other appropriate indexing quantity). The fourth column contains a Boolean variable indicating whether or not the last deployment event was observed. A "1" corresponds to the affirmative condition where the deployment event is observed and a "0" to the negative indicating that the last deployment event was not observed. The Probability of Discrimination column of FIG. 3 shows various values, each of which is greater than or equal to zero and less than unity (1). In FIG. 3, for illustrative purposes only, two SNR and two aspect angle bins are used. Aspect angle bin number 1 includes aspect angles from 0 to 90 degrees while aspect angle bin number 2 includes aspect angles greater than 90 degrees and less than or equal to 180 degrees. Similarly, SNR bin 1 includes SNR values from 0 to 50 dB and SNR bin number 2 includes SNR values greater than 50 dB but less than or equal to 100 dB. In addition, only two separation events are considered for the example threat of FIG. 3, namely separations 1 and 2. For each combination of SNR, aspect angle, and deployment event, and deployment event observed status there is a corresponding value of probability of discrimination.

Probability of discrimination tables can be established by a subject matter expert or using a software tool. When detailed information is available about a ballistic missile a software tool can be used to establish discrimination performance as a function of SNR, aspect angle, last deployment event, and last deployment event observability. The software tool uses high fidelity information about the threats. This information includes the RCS for all viewing angles, rotational dynamics of the threat complex objects and trajectory related information. A classifier is used to determine the discrimination performance that can be expected for the threat based on the SNR, aspect angle, phase of deployment and whether or not the last deployment event was observed. For the most part, the classifier performance depends on the types of features used and the exploitation of conditional relationships between the features used for discrimination. In general, two different classifiers making use of the same information will achieve similar performance.

This method of evaluating discrimination performance is superior to prior art because it provides a much better estimate of discrimination performance using only a simple sensor model and limited threat missile information.

Figure 4:
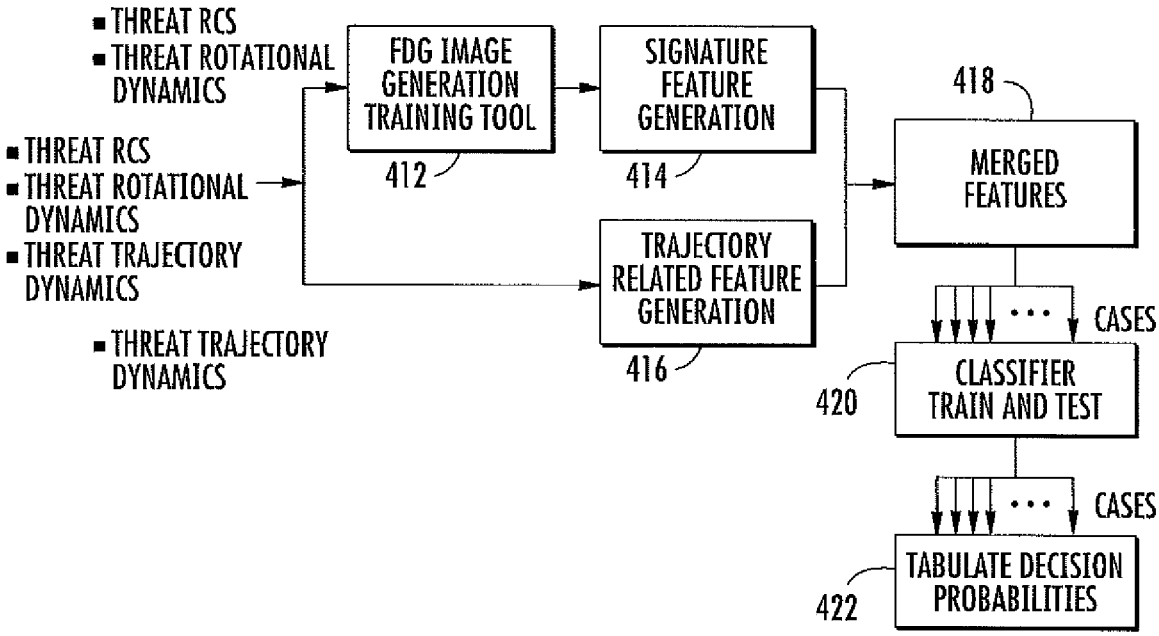
FIG. 4 is a simplified block diagram illustrating a method for generating the table of FIG. 3.

FIG. 4 describes the processing used to generate the lookup tables and establish discrimination performance when some information about the threats of interest is available. As in the case of other methods, the processing may be performed at any location, or may be distributed among a plurality of locations. In general, the threat model contains information about the threat missile translational and rotational dynamics as well as the spectral signature relevant to the sensors of interest. In a particular embodiment, the characteristics are the threat missile trajectory, the threat missile radar cross-section (RCS) and the threat missile rotational dynamics. Block 412 generates training signals using threat model information and a high fidelity sensor model. The training signals are generated for the full set of known threat dynamic behaviors. Additionally, signals are generated over the expected operational range sensor frequencies, waveforms and signal to noise ratios. For each set of threat and sensor parameters, multiple realizations are generated in order to capture the expected statistical behavior of the threat system and sensor. The training signals are applied from block 412 to a block 414, which represents generation of signature features. Signature features are measurements derived from the raw training signals. These are generally quantities that help to distinguish one object from another. In Block 416, features derived from threat trajectory information are derived. The signature features from block 414 and the trajectory related features from block 416 are merged in a block 418, to produce sets of cases. The various cases are made available to a classifier. Classifiers are known in the art, and are described, for example, in "Pattern Classification" Duda, Hart and Stork, John Wiley and Sons, Inc., 2001, ISBN 0-471-05669-3. The training and testing of the classifier involves using half of the cases to train the classifier to recognize the lethal object among all likely objects in a threat complex. The trained classifier is then tested using the remainder of the cases. The performance of the classifier is tabulated. Performance is recorded as well as aspect angle, SNR, last deployment event prior to classification, and whether or not the deployment event was observed. In Block 422, performance is tabulated as a function of aspect angle, SNR, last deployment event prior to classification, and whether or not the deployment event was observed. This tabulation results in the generation of the table (FIG. 3).

As mentioned above, we can use information on the RCS, rotational dynamics and trajectory specific information. The RCS is usually delivered in the form of high fidelity cross section models of the complex objects indexed by azimuth, roll and frequency. A large number of simulated measurements are generated that sample the relevant angular and rotational dynamics distributions. Signature features are then extracted from this data. The trajectory related features are statistically generated and added to the signature feature database. Harvested data is divided into train and test sets used to train and test a classifier. Testing is performed for all combinations of observation type availability and SNR. Results are tabulated over thousands of Monte Carlo Runs.

Figure 5:
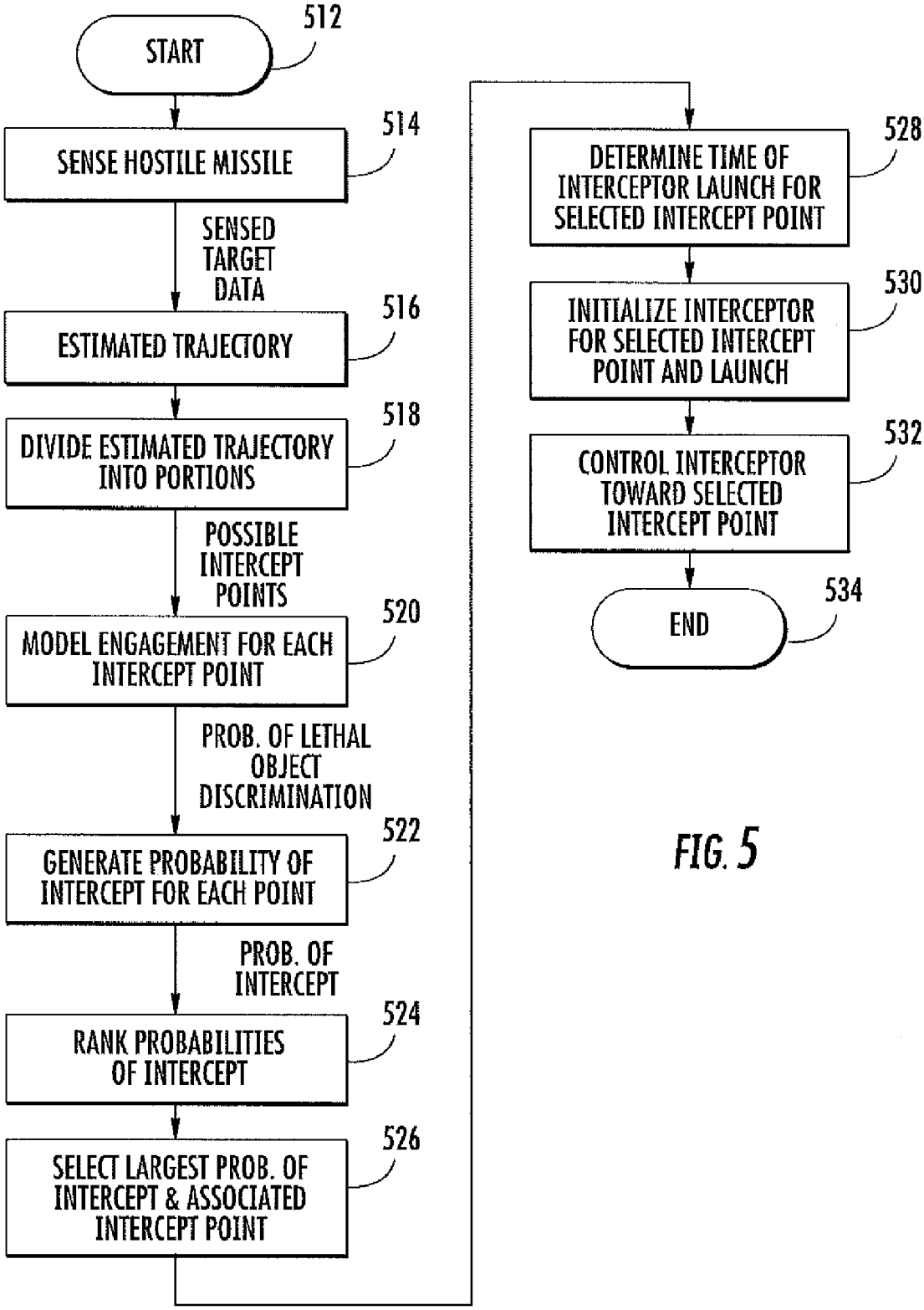
FIG. 5 is a logic flow chart or diagram illustrating the steps in sensing a target missile, generating an estimated target trajectory, dividing the estimated trajectory into portions to define possible intercept point(s), modeling the engagement for each possible intercept point to generate probability(ies) of lethal object discrimination, generating probability(ies) of intercept for each possible intercept point, selecting that one intercept point which has the largest probability of intercept, calculating an intercept missile launch time, initializing interceptor missile guidance with information relating to the selected intercept point, and launching the interceptor missile at the launch time and under the control of interceptor missile guidance; and controlling an interceptor missile towards an intercept point with a target missile.

FIG. 5 illustrates the overall process or method for engaging a hostile or target missile with an interceptor missile. In FIG. 5, the steps begin at a Start block 512, and proceed to a block 514. Block 514 represents the sensing of the target missile, as by scanning a volume with a radar sensor for detection, followed by tracking with the radar. The result of the sensing is the generation of sensed target data. The sensed target data is made available for determination of an estimated trajectory (20*et* of FIG. 1), as suggested by block 516 of FIG. 5. The estimated trajectory is divided into portions by calculation, as indicated by block 518. A trajectory (20*et*) is divided into portions by first computing a first and last point on the trajectory. The first and last points could correspond to the first and last point that a missile in inventory can intercept the target missile, or in as more general case the current location of the target missile and the point where the target missile is estimated to impact the earth. Individual points are computed by dividing the trajectory between the first (20*et*1) and last time (20*et*5) into equal segments. This can be accomplished by, for example, dividing the last time minus the first time by the number of desired points. The exact method of picking the particular points is not critical.

The portions define potential or possible intercept points (20*et*N). Block 520 represents the modeling of the engagement at each of the possible intercept points, as described in more detail in conjunction with FIG. 6. The modeling of the engagements as performed in block 520 of FIG. 5 generates a probability of lethal object discrimination for each potential intercept point. It should be noted that if the target consists of only one object, the probability of discrimination of that single object is always 1.0. Block 522 represents the generation of a probability of intercept for each probability of discrimination, which gives rise to a probability of intercept for each potential intercept point. Block 524 represents the ranking of the probabilities of intercept from lowest to highest. Block 526 represents selection of that probability of intercept which is largest, with the identity of the associated possible intercept point being carried along. From block 526, the method of FIG. 5 flows to a block 528. Block 528 represents the determination of the interceptor launch time for the selected one of the intercept points. Block 530 represents the initialization of the interceptor missile launch and guidance system with information relating to the selected intercept point, and the launching of the interceptor missile. It should be noted that it is often the case that the interceptor missile will be guided by interceptor missile controls which are not on the missile itself, but the control instructions are sent from remote locations. In some cases, final or terminal guidance may be autonomous with the interceptor missile. Block 532 of FIG. 5 represents guidance of the interceptor missile toward the selected intercept point. The method ends at an END block 534.

Figure 6:
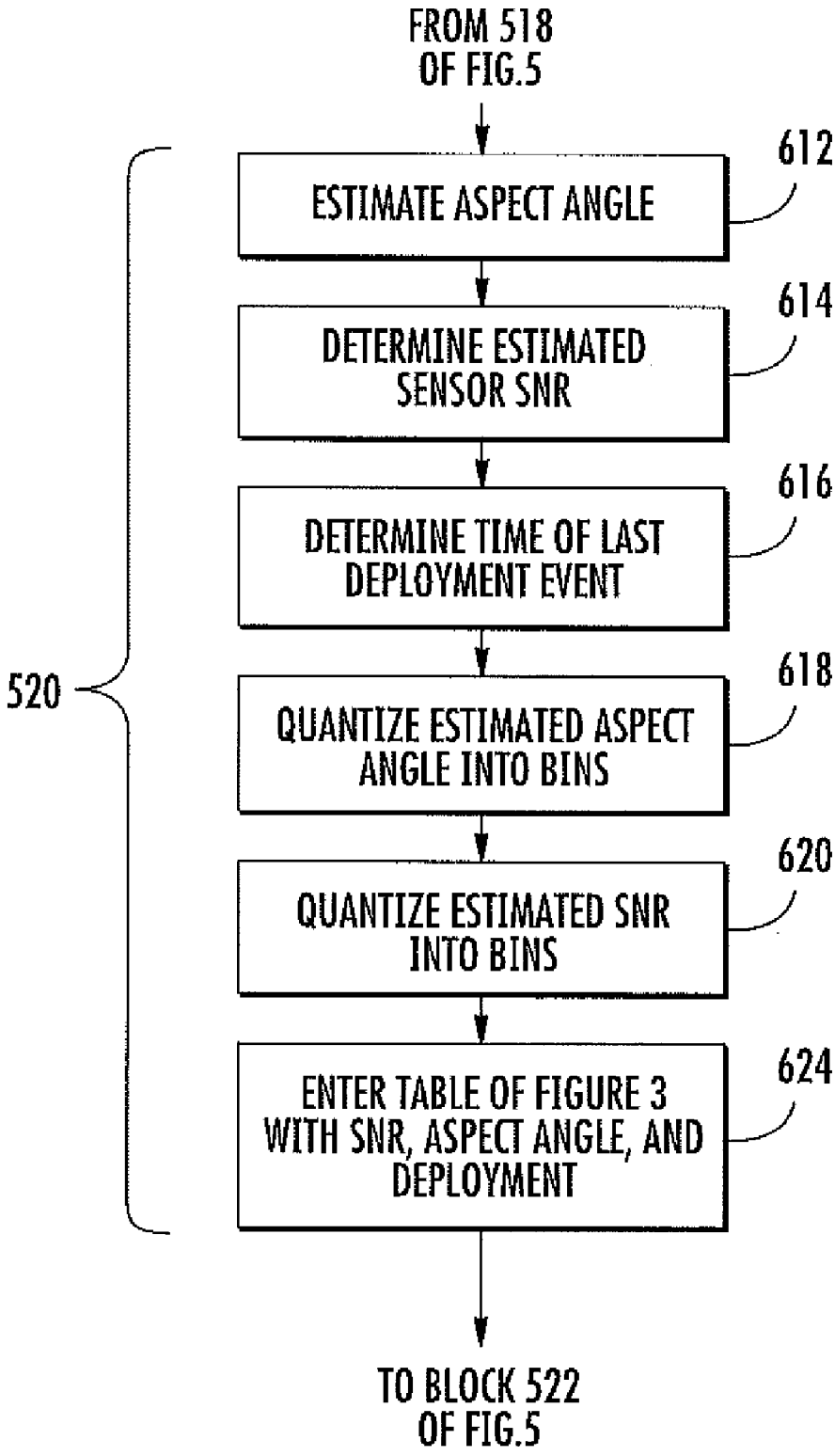
FIG. 6 is a logic flow chart or diagram illustrating processing in a portion of the diagram of FIG. 5.

FIG. 6 is a method flow chart or diagram illustrating details of model engagement block 520 of FIG. 5. In FIG. 6, the logic or method flows from block 518 of FIG. 5 to a block 612. Block 612 represents determination of the estimated aspect angle between the sensor and the estimated lethal object. Block 614 represents determination of the signal-to-noise ratio (SNR) of the sensor, based on the aspect angle computed in block 612 and on the estimated radar cross section (or other) characteristics of the lethal object associated with the target missile. The target missile deployment event occurring before the estimated target trajectory point of interest is determined in a block 616. The aspect angle and SNR are quantized into bins, as described above, in blocks 618 and 620, respectively. If deployment time is known, it is also quantized. With the estimated SNR, aspect angle, and last deployment time available, the table previously prepared as described in conjunction with block 216 of FIG. 2 is entered at the estimated SNR, aspect angle, and time of last deployment event. The method of FIG. 6 ends with block 624, which represents entering the table with the SNR, aspect angle, and last deployment event time to determine the probability of lethal object discrimination. The logic flows from block 624 of FIG. 6 back to block 522 of FIG. 5.

A method according to an aspect of the invention is for engaging a hostile missile (20) with an interceptor missile (40). The method comprises the steps of sensing a hostile missile (20) to thereby generate sensed target data, and generating from the sensed target data an estimated target trajectory (20*et*). The estimated target trajectory (20*et*) is mathematically divided into portions (20$et_{1,2}$, 20$et_{2,3}$, 20$et_{3,4}$, . . . ). The junction of each the portion (20$et_{1,2}$, 20$et_{2,3}$, 20$et_{3,4}$, . . . ) with the next defines a possible intercept point (20*et*2, 20*et*3, . . . ). The engagement for each of the possible intercept points is modeled (520), to thereby generate a probability of lethal object discrimination. The probability of lethal object discrimination is processed to generate a probability of intercept (522) for each of the possible intercept points. That one of the possible intercept points having the largest probability of intercept is selected (524, 526) to define a selected intercept point. From the selected intercept point, an intercept missile launch time is calculated (528). The interceptor missile (40) guidance (530) is initialized with information relating to the selected intercept point. The interceptor missile (40) is launched (530) at the calculated launch time and under the control of the interceptor missile (40) guidance (532).

What is claimed is:

1. A method for engaging a hostile missile with an interceptor missile, said method comprising the steps of:

sensing a hostile missile with a sensor to thereby generate sensed target data;

generating from said sensed target data an estimated target trajectory;

mathematically dividing said estimated target trajectory into portions, the junction of each of said portions with the next defining a possible intercept point;

modeling the engagement for each of said possible intercept points to thereby generate a probability of lethal object discrimination;

processing said probability of lethal object discrimination to generate a probability of intercept for each of said possible intercept points;

selecting that one of said possible intercept points which has the largest probability of intercept to define a selected intercept point;

from said selected intercept point, calculating an intercept missile launch time;

initializing interceptor missile guidance with information relating to said selected intercept point; and launching said interceptor missile at said launch time and under the control of said interceptor missile guidance.

2. A method according to claim 1, wherein said step of modeling the engagement comprises the steps of:

prior to said engagement, determining the noise performance of said sensor as a function of at least aspect angle and range;

prior to said engagement, generating a table of probability of lethal object discrimination as a function of estimated signal-to-noise ratio and of aspect angle;

determining estimated signal-to-noise ratio from said noise performance of said sensor and said sensed target data;

entering said table with said aspect angle and estimated signal-to-noise ratio for each of said possible intercept points to thereby generate said probability of lethal object discrimination for each of said possible intercept points determining the signal-to-noise ratio of said sensor data;

determining the aspect angle between the sensor and a lethal object in a given coordinate system;

quantizing said signal-to-noise ratio into a bin;

quantizing said aspect angle into a bin;

entering said table with said signal-to-noise ratio and said aspect angle to determine the probability of lethal object discrimination.

3. A method for estimating discrimination performance of a system of sensors, said method comprising the steps of:

determining the noise performance of a sensor;

acquiring real-time data from said sensor relating to a lethal object in an environment;

determining the signal-to-noise ratio of said sensor data;

determining the aspect angle between the sensor and a lethal object in a given coordinate system;

generating a table of probability of lethal object discrimination as a function of signal-to-noise ratio and of aspect angle;

quantizing said signal-to-noise ratio into a bin;

quantizing said aspect angle into a bin;

entering said table with at least said signal-to-noise ratio and said aspect angle to determine the probability of lethal object discrimination.

* * * * *